US007850148B2

(12) United States Patent
Collins, IV

(10) Patent No.: US 7,850,148 B2
(45) Date of Patent: Dec. 14, 2010

(54) FIXTURE AND MOUNTING ASSEMBLY FOR A FENCE POST

(75) Inventor: Earle S. Collins, IV, Somers Point, NJ (US)

(73) Assignee: Collins Limited, LLC, Somers Point, NJ (US)

( * ) Notice: Subject to any disclaimer, the term of this patent is extended or adjusted under 35 U.S.C. 154(b) by 181 days.

(21) Appl. No.: 11/658,927

(22) PCT Filed: Jun. 22, 2005

(86) PCT No.: PCT/US2005/022020

§ 371 (c)(1),
(2), (4) Date: May 12, 2009

(87) PCT Pub. No.: WO2006/023045

PCT Pub. Date: Mar. 2, 2006

(65) Prior Publication Data

US 2009/0212270 A1 Aug. 27, 2009

Related U.S. Application Data

(63) Continuation of application No. 11/037,865, filed on Jan. 18, 2005, now abandoned, which is a continuation-in-part of application No. 10/903,026, filed on Jul. 30, 2004, now abandoned.

(51) Int. Cl.
*E04H 17/00* (2006.01)

(52) U.S. Cl. ..... 256/65.14; 256/DIG. 5; 248/156; 52/169.9

(58) Field of Classification Search ..... 256/19, 256/59, 65, 65.14, 66, DIG. 5; 403/222, 403/362; 248/53, 156, 188.8, 519, 527, 545; 52/169.9, 263, 298
See application file for complete search history.

(56) References Cited

U.S. PATENT DOCUMENTS

| | | | |
|---|---|---|---|
| 3,691,776 | A | 9/1972 | Hull |
| 3,921,960 | A | 11/1975 | Bright |
| 3,924,834 | A | 12/1975 | Young |
| 4,326,352 | A | 4/1982 | Barth |

(Continued)

FOREIGN PATENT DOCUMENTS

DE 35 33 282 A1 4/1986

*Primary Examiner*—Michael P Ferguson
*Assistant Examiner*—Nahid Amiri
(74) *Attorney, Agent, or Firm*—Lerner, David, Littenberg, Krumholz & Mentlik, LLP

(57) ABSTRACT

A post assembly (20) for a hollow post. (12) includes an elongated support (14), preferably a standard pipe, at least one fixture (10), and, optionally, a mount (100). The fixture (10) includes a fitting (22) having a bore (28) for receiving the elongated support (14), and a web (24) that extends from the fitting (22) to support a plurality of friction plates (26) adapted to engage the inner walls of the hollow post (12). When employed, the mount (100) allows for adjustment of the vertical alignment of the elongated support (14). The elongated support (14) is attached to a bracket (102) which is positioned over a base (104) having a plurality of members (106) extending upward through holes in the bracket. Movement of adjustment members (112) positioned between the base (104) and bracket (102) allow for adjustment of the angle of the elongated support (14). A method of installation using the fixture and mounts of the invention is also provided.

32 Claims, 8 Drawing Sheets

U.S. PATENT DOCUMENTS

| | | | |
|---|---|---|---|
| 4,635,905 | A | 1/1987 | Fontana |
| 4,972,642 | A | 11/1990 | Strobl, Jr. |
| 5,209,450 | A | 5/1993 | Grapes |
| 5,359,827 | A | 11/1994 | Gehman |
| 5,404,682 | A | 4/1995 | West |
| 5,704,188 | A | 1/1998 | Coulis |
| 5,709,366 | A | 1/1998 | Speece |
| 5,755,431 | A | 5/1998 | Williams |
| 5,816,554 | A | 10/1998 | McCracken |
| 5,901,525 | A | 5/1999 | Doeringer et al. |
| 5,946,871 | A | 9/1999 | Kassardjian et al. |
| 6,141,928 | A | 11/2000 | Platt |
| 6,213,452 | B1 | 4/2001 | Pettit et al. |
| 6,279,879 | B1 | 8/2001 | Statz |
| 6,467,756 | B1 | 10/2002 | Elasser |
| 6,508,457 | B1 | 1/2003 | Knudson et al. |
| 6,523,808 | B1 | 2/2003 | Lehmann |
| 6,557,831 | B2 | 5/2003 | Erwin |
| 6,718,710 | B2 | 4/2004 | Platt |
| 6,868,641 | B2 | 3/2005 | Conner et al. |
| 2002/0110428 | A1 | 8/2002 | Noggle |
| 2003/0233793 | A1 | 12/2003 | Burkart et al. |

FIXTURE AND MOUNTING ASSEMBLY FOR A FENCE POST

CROSS-REFERENCE TO RELATED APPLICATIONS

This application claims the benefit of U.S. patent application Ser. No. 10/903,026, filed Jul. 30, 2004, entitled Fixture And Mounting Assembly For A Fence Post, and U.S. patent application Ser. No. 11/037,865, filed Jan. 18, 2005, entitled Fixture And Mounting Assembly For A Fence Post, the disclosures of which are hereby incorporated by reference herein.

BACKGROUND ART

In recent years, plastic, and particularly vinyl fences have become common and popular as an alternative to traditional wood fencing. These fences are stronger, longer lasting, safer, and virtually maintenance free. They are also largely weather resistant and impervious to pests such as termites. The color of the vinyl is integral to the fence, and the vinyl composition is often modified to incorporate ultraviolet protective agents (such as titanium oxide), eliminating the need for paints or stains. Vinyl fencing can come in a variety of styles, mimicking traditional picket, semi-private, privacy, and even wrought iron fencing. Most fence posts for vinyl fencing are of hollow construction, and while a variety of shapes are possible, the most common has a square cross-section and a corresponding square inner cross-section.

The conventional method for installing a post, including vinyl fence posts, has been to excavate a post hole, place the post into the hole, and secure the post using concrete. However, a variety of devices have been proposed as an alternative method of installation.

For example, U.S. Pat. No. 5,709,366 to Speece discloses a fence post support which includes a ground engaging spike and an upper portion for engaging the hollow end of a fence post. The post-engaging element includes a pair of angle irons in an X-shaped configuration, the edges of which are adapted to engage the interior corners of the square-shaped interior of a hollow fence post. Also disclosed is a threaded element for expanding the angles of the post-engaging element, thereby securing the fence post to the support.

One drawback of the device-disclosed in Speece is that the fence post is supported from the base only. Often, and particularly with respect to hollow fence posts, additional support against lateral forces applied to the fence post are desired. This is particularly true for endposts and gateposts. Traditionally, this has been addressed by simply placing treated wooden stakes or rebar (steel rods) within the post prior to setting in, concrete. However, several fixtures have been proposed as an improved alternative.

For example, U.S. Pat. No. 5,755,431 to Williams discloses a fixture which secures a hollow fence post to a "T" shaped stake which can be driven into the ground. The fixture includes a central inner housing for frictionally engaging the stake, and an outer, generally triangular peripheral member connected to the inner housing by a web. The triangular peripheral member is adapted to frictionally engage the post along the three corners thereof. These fixtures can be provided at multiple locations within the fence post to provide additional support.

Because it is readily available, relatively inexpensive, and easily cut to required lengths, standard pipe is an excellent support structure for hollow fence posts. Fixtures used in connection with standard pipes have been utilized to provide additional support and account for differences between the size of the pipe and the inner dimensions of the fence post.

For example, U.S. Pat. No. 5,704,188 to Coulis employs coiled springs which, fit tightly around an anchored pipe, the coiled springs having extensions which fit into the interior corners of a hollow rectangular fence post.

U.S. Pat. No. 6,523,808 to Lehmann discloses a fixture constructed of a pair of connected inner and outer cylinders. The inner cylinder extends beyond one end of the outer cylinder and has holes therein for fastening the fixture to a pipe. The outer cylinder is connected to the inner cylinder by a web, a hollow fence post can then be fitted over the outer cylinder.

In the many uses of posts supported by the various means discussed above, and particularly in the construction of fences, it is often necessary to attach hardware, such as brackets and hinges. While there are many advantages to using, hollow vinyl posts, the conventional method of using screws to attach such hardware is problematic because the thickness of the walls of the posts is often insufficient. It would therefore be advantageous to provide a fixture for a hollow post that, in addition to positioning the post, provides additional support for conventional hardware.

Moreover, in the vinyl fence post industry, there are many manufacturers, and the interior dimensions of such fence posts can vary significantly. Accordingly, it is desirable to provide a fixture for a hollow fence post that accounts for differences in design and acceptable manufacturing tolerances.

Generally, it would be very desirable to have a fixture for securing a hollow post to a support structure such as a standard pipe that is simple, versatile and easily manufactured.

In some instances, a post such as that employed in vinyl fencing is not secured to the ground, but is instead attached to a structure, such as a wood deck or a cement floor. In those instances, a mount having a base plate for attachment to a structure is typically employed.

For example, U.S. Pat. No. 6,508,457 to Knudson et al. describes a mount for a vinyl fence post that includes a base having mounting holes for attachment to a structure. Extending from the base is a pair of elongated support members in an X-shaped configuration providing contact with the inner corners of hollow fence post having a rectangular cross-section.

U.S. Pat. No. 5,359,827 to Gehman discloses a mount for a hollow fence post including a base plate with holes for receiving set screws for attachment to a base. Extending vertically from the four corners of the rectangular base plate are four angle irons. Attached to the opposite end of the angle irons is a rectangular top plate which can be adjusted by a screw mechanism to lock the fixture against the inside corners of the fence post.

U.S. Pat. No. 3,924,834 to Young discloses a newel post for a balustrade which is mounted using a clamping mechanism having a pair of expandable wedges. A bolt passed through a hole in a boss and engages the wedges, causing them to bear against the inside wall of the hollow newel post and clamp the boss to a nut positioned in the bore of a substrate.

One problem associated with the mounts of the prior art lies in adjusting the vertical alignment of the post. Variations in the surface of, for example, a wood deck, can cause a post using such mounts to lean at an undesirable angle. In some instances, the structure may simply not be appropriately level. To correct the vertical alignment, it is often necessary to use a shim, which can be unsightly and unstable.

For example, U.S. Published Application No. 2003/0233793 to Burkart et al. relates to a post mounting system having individually adjustable angled clamping members which contact the interior of a hollow plastic post and secure the post against the retaining wall of a base member. Disclosed therein is an angled circular shim member that can be fitted under the entire base member of the mount to adjust the vertical alignment.

Thus, also needed are improvements with respect to mounts for hollow posts that overcome the shortcomings of the above devices.

SUMMARY OF THE INVENTION

The general purpose of the present invention is to provide new and improved post assemblies, fixtures and mounts for use in connection with the installation of hollow posts, and methods of installation using these new and improved devices.

In one embodiment, there is provided a fixture for mounting a hollow post to an elongated support structure such as a pipe. The fixture includes a fitting having a bore adapted to receive the support structure. Extending from the fitting is a web that connects the fitting to a plurality of friction plates. Preferably, the fixture includes four friction plates, and includes a fastener for securing the fixture to the support structure.

A preferred embodiment of the fixture includes a web in the form of a horizontal plate having four peripheral edges from which four friction plates extend. It is also preferred that the friction plates extend from the respective edges of the horizontal plate at an obtuse angle formed between the horizontal plate and the friction plate.

In another embodiment, the friction plates define a hollow cavity underlying the web, and the fitting extends within that cavity. In the case where fasteners used to connect the fitting to a pipe are located within this cavity, at least one of the friction plates is provided with an access opening so that the fastener can be engaged or disengaged to secure or release the fixture from the pipe.

In another embodiment, provided is a post assembly including one or more fixtures such as those just described to position a hollow post in relation to, a pipe. The post assembly includes a standard, pipe which is positioned within a hollow post having a square inner cross-section defined by a plurality of inner walls. For positioning the hollow post over the pipe, there is provided at least one fixture disposed within the post, the fixture including a fitting having a bore, the pipe being disposed within the bore and secured thereto by a fastener. A web extends outwardly from the fitting, and a plurality of friction plates extend from the web, each friction plate having a surface for engaging an inner wall of the hollow post. The friction plates are situated so that at least two opposing inner walls of the hollow post are engaged. Preferably, the fixture includes four such friction plates, each friction plate engaging a separate inner wall of the post.

Another embodiment of the invention relates to an adjustable mount for a hollow post. The adjustable mount includes an elongated support structure, such as a pipe, which is adapted for positioning within a hollow fence post. The support structure extends from a mounting bracket which is positioned over a base. Extending upwardly from the base are a number of threaded members which extend through a number of holes in the mounting bracket. Adjustment members, such as a conventional nut, are positioned onto each of the threaded members between the base and the mounting bracket, so that movement of the adjustment members adjusts the angle of the elongated support structure relative to the base.

Another embodiment of the invention is a post assembly that combines a pipe, one or more fixtures and an adjustable mount. A hollow post is provided having a square inner cross-section defined by four inner walls. A pipe is disposed within the post, secured to one of more fixtures. The fixtures include a fitting and a web connecting the fitting to a number of friction plates. The pipe is disposed within a bore in the fitting and secured thereto by at least one fastener. The web extends outwardly from the fitting, and a number of friction plates extend from the web, each friction plate having a surface that engages one of the inner walls of the post, the friction plates positioned so that at least two opposing inner walls are engaged by separate friction plates.

The adjustable mount of this embodiment includes a mounting bracket having a number of holes therein, the pipe extending from the mounting bracket, and a base underlying the bracket and having a number of threaded members extending upwardly through the holes. An adjustment member is positioned on each of the threaded members between the bracket and the base, whereby movement of the adjustment member along the threaded member adjusts the angle of the pipe relative to the base.

Also provided is a method of installing a hollow post including the steps of mounting a pipe to a structure such as the ground or a wood deck, securing a fixture such as those just described to the pipe, and then fitting a hollow post over the pipe and fixture. In another embodiment, an adjustable mount such as those described above is employed to mount the pipe to a structure, and the installation method includes the step of adjusting the vertical position of the pipe by rotating one or more of the adjustment members.

Additional features and benefits of the present invention are provided in the particular embodiments of the invention described herein in the Detailed Description of the invention, as well as in the various embodiments of the invention set forth in the accompanying figures.

BEST MODE FOR CARRYING OUT INVENTION

Throughout the drawings similar numbers are used to indicate similar, structures in the various embodiments of the invention.

In describing the preferred embodiments of the subject matter illustrated and to be described with respect to the drawings, specific terminology will be resorted to for the sake of clarity. However, the invention, is not intended to be limited to the specific terms so selected and it is to be understood that each specific term includes all technical equivalents which operate in a similar manner to accomplish a similar result.

Figure 1:
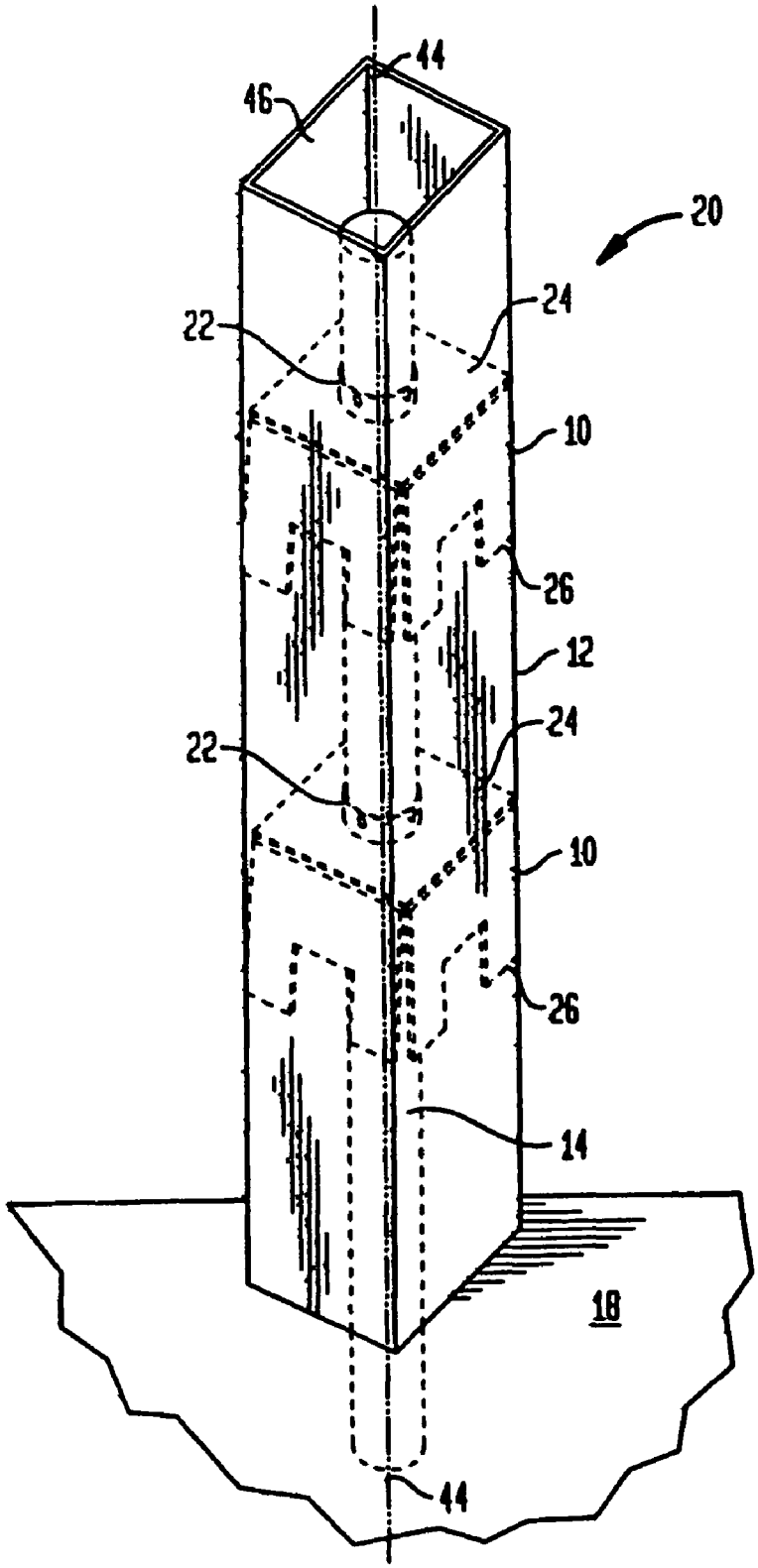
FIG. 1 is a perspective view of a post assembly including a hollow post, two fixtures and an elongated support.

The present invention pertains to a post assembly, and particularly to a post assembly for a hollow vinyl fence post. Referring to FIG. 1, a preferred embodiment of a post assembly 20 is shown. The post assembly 20 includes at least one fixture 10 (two fixtures are shown) which is employed to position a hollow post 12 in relation to an elongated support structure 14. The support structure 14 is mounted to a base structure 18, which may be, for example, an earth base, a wooden or vinyl deck, or a cement floor.

In the preferred embodiment of the invention, the elongated support structure 14 is a standard cylindrical pipe. Pipe of this type is a common construction material, being inexpensive and easy to work with in that it can be, readily cut to any desired length. However, a variety of elongated support structures can be used and the dimensions of the bore 28 of fittings 22 (FIG. 2) can be adapted accordingly. For example, a rod having a square or cylindrical cross section can readily be used in place of a pipe, as well as other shapes such as polygonal, rectangular, oval and the like.

Figure 2:
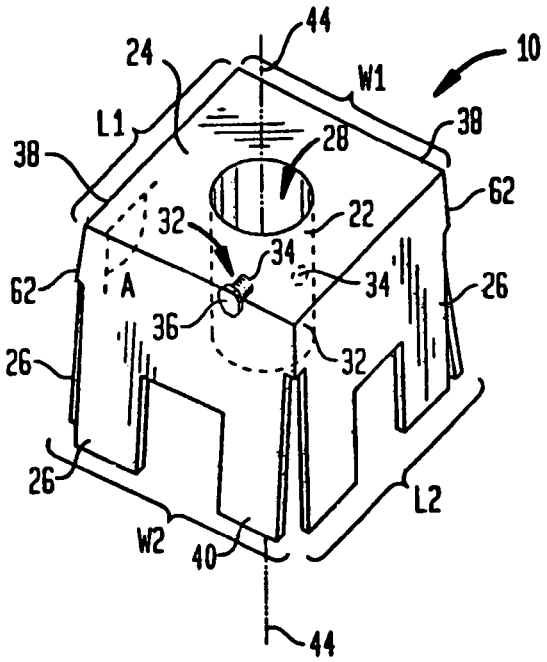
FIG. 2 is a perspective view of a preferred fixture of the invention.

Positioning elongated support structure 14 within a hollow post 12 is accomplished by using one or more fixtures 10, which are depicted in greater detail in FIGS. 2-6. The basic elements of fixtures 10 of the invention are a central fitting 22, a web 24, and a plurality of friction plates 26. A preferred embodiment of a fixture 10 of the invention is depicted in FIG. 2.

Fitting 22 is preferably in the form of a cylinder, open at both ends, with an outer surface 32, and a bore 28. The bore 28 is adapted to receive elongated support structure 14, and is preferably cylindrical to accommodate a cylindrical pipe. The dimensions of the bore can be adapted to receive any number of elongated support structures known to those of skill in the art. The dimensions of the bore 28 should permit the fitting 22 to be easily moved to a desired vertical position along the elongated support 14, and at the same time, minimize the amount of movement of the elongated support 14 within the bore 28. In one embodiment, the dimensions of the bore 28 are only slightly greater than those of the exterior of the elongated support 14, such that some frictional resistance is provided between the outer surface of the elongated support 14 and the inner surface defining the bore 28.

Optionally, one or more protrusions 120 (FIGS. 10-12) may be provided within the bore 28 of the fitting 22 which assist in positioning the elongated support 14 within the bore 28. Preferably, two such protrusions are provided, more preferably three or more are provided to insure that the elongated support 14 is positioned centrally within the bore 28. Preferably, two sets of such protrusions 120, an upper and lower set are provided as depicted in FIGS. 10-12.

Figure 10:
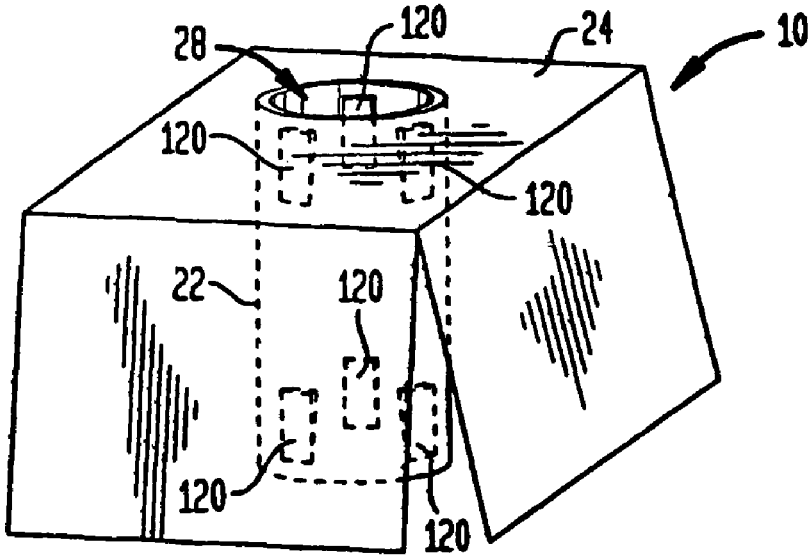
FIG. 10 is a perspective view of a fixture having a fitting with positioning wedges.
Figure 11:
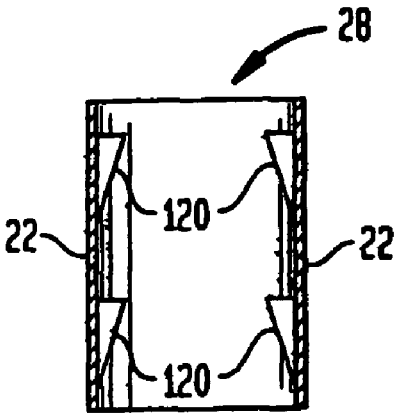
FIG. 11 is a side cross-sectional view of a fitting with positioning wedges.
Figure 12:
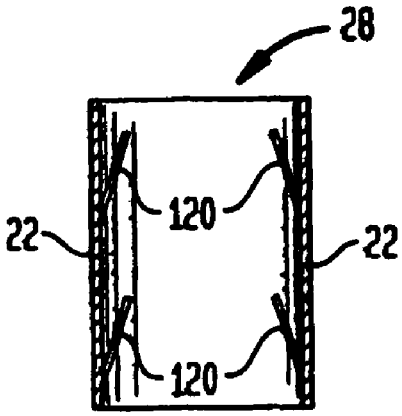
FIG. 12 is a side cross-sectional view of a fitting having positioning strips.

In one embodiment these protrusions 120 are in the form of a wedge, the thin, leading portion of the wedge being positioned downward within the bore 28 to allow the fixture 10 to be fitted onto the elongated support 14 (FIGS. 10-11). The wedges 120 are preferably made of a resilient material that will give when the elongated support 14 is fitted into place. Referring to FIG. 12, in an alternative embodiment, the protrusions comprise a strip of materially, preferably rectangular in shape, resiliently connected to an inner wall of said fitting 22.

Figure 13:
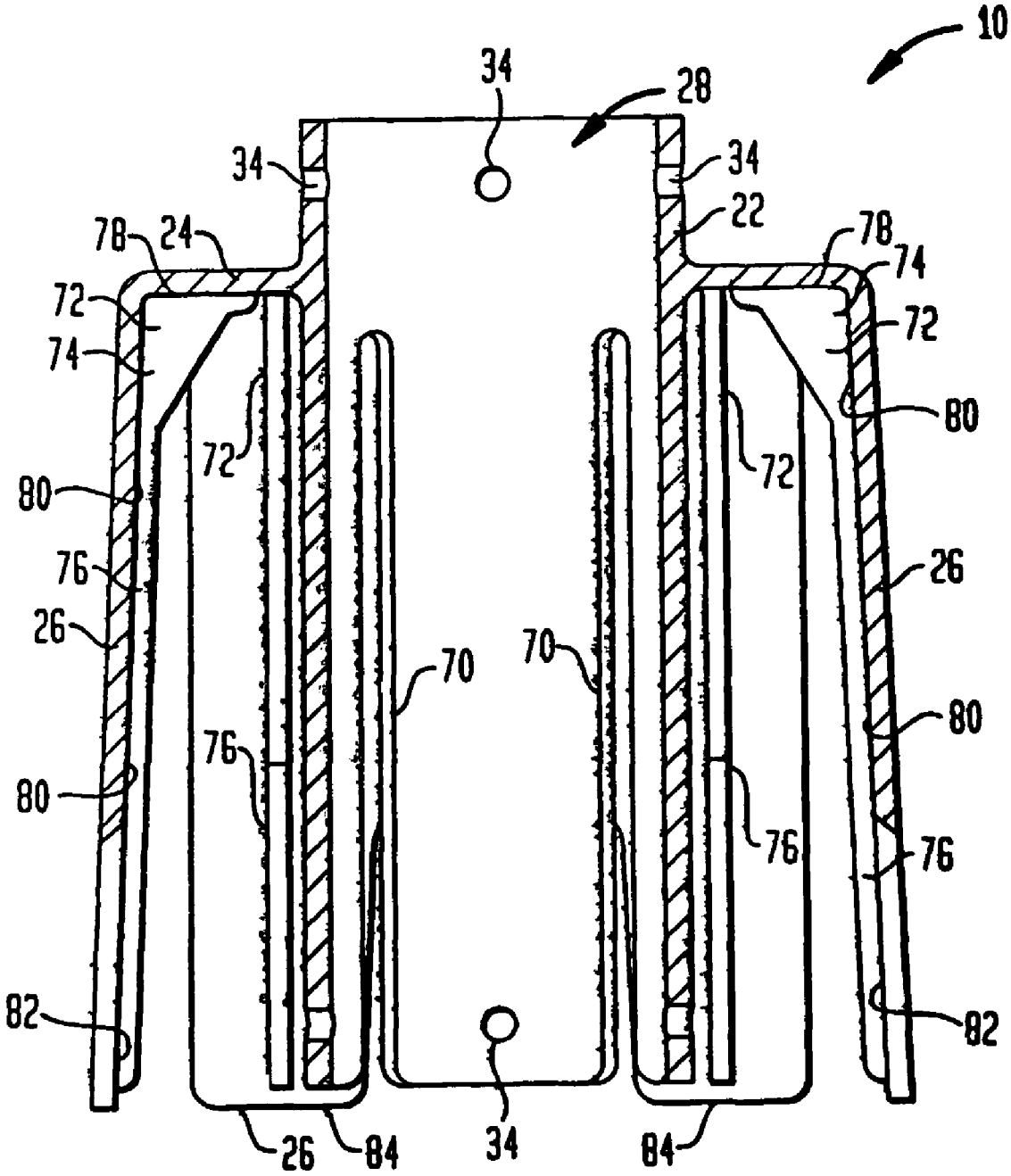
FIG. 13 is a side cross-sectional view of a fixture having support fins and expansion slots.
Figure 14:
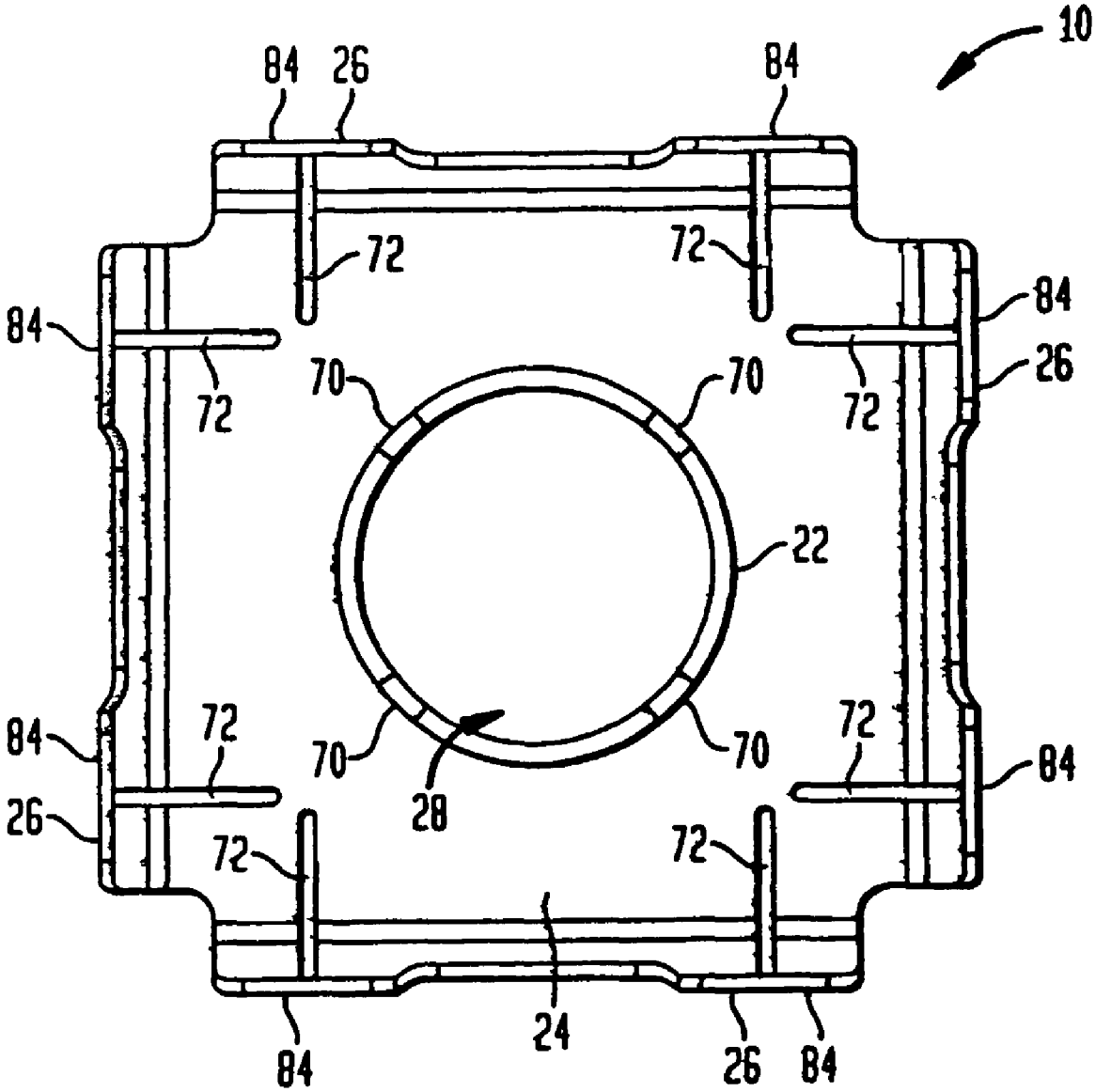
FIG. 14 is a bottom perspective view of a fixture having support fins and expansion slots.

In a preferred embodiment shown in FIGS. 13 and 14, instead of protrusions, the fitting 22 includes more than one, preferably two, and more preferably four, longitudinal expansion slots 70. These slots 70 allow the fitting 22 to expand radially, which provides for an easy fitting over an elongated support structure 14. This radial expansion is also beneficial in that the fixture can allow for some variation in the size, and defects or damage to, the elongated support structure 14.

As shown, the slots extend from the bottom of fitting 22 along the length thereof. The length of these slots is not critical, however, one should recognize that the longer the slot 70, the greater the flexibility provided to fitting 22. In another embodiment, one or more slots can run the entire length of the fitting, providing maximum flexibility. However, in the preferred embodiment a portion of the fitting should remain as a solid cylinder to provide strength to the fitting against external forces applied to a post fitted on the fixture. Similarly, the width of the slots is not critical, and the term "slot" can refer to a simple slit or gap in the fitting 22.

In a particularly preferred embodiment, the fixture 10 will include four such expansion slots 70, arranged in equal radially spaced apart positions about the circumference of the fitting 22. As shown in FIG. 14, in the preferred embodiment, the slots 70 are positioned towards the corners of the fixture.

In the mounting of a hollow post, the position of the fixtures 10 within the post can be adjusted to meet the needs of the particular application. Once in position, the fixture 10 can be secured in place by means of a fastener 32, by way of a threaded bolt or screw 36 received by a hole 34 as shown in FIG. 2. In a preferred embodiment, a screw is employed which is driven into the elongated support structure 14. In the case where a bolt is employed, the hole 34 can be threaded to receive the bolt. In the preferred embodiment, fitting 22 will include more than one, more preferably four, such holes 34 spaced equidistantly apart from one another about the circumference of the cylindrical fixture.

Other methods of positioning the fixtures 10 in relation to an elongated support structure 14 should be recognized by those of skill in the art. For example, an adjustable clamp can be employed, or an o-ring can be fitted around the elongated support 14 above and/or below the fitting 22. In some applications, it may be desirable to position a fixture 10 at the end of an elongated support 14. In that instance a fixture 10 can be provided wherein the upper end of the fitting 22 includes a stop (not shown) or the uppermost end of the bore is enclosed. In yet another embodiment, the elongated support structure 14 may include one or more stops (not shown), such as a circumferential lip, or holes for a pin, upon which the fitting 22 may rest.

Figure 3:
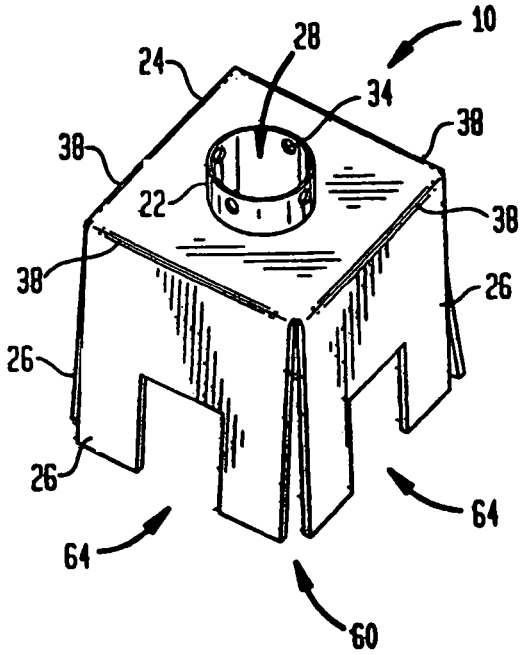
FIG. 3 is a perspective view of a second embodiment of the invention.
Figure 5:
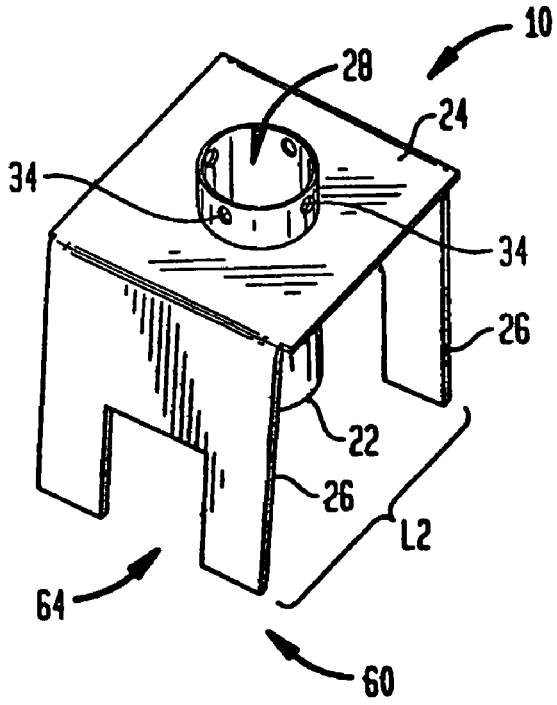
FIG. 5 is a perspective view of a fixture for a hollow post having two opposing friction plates.
Figure 6:
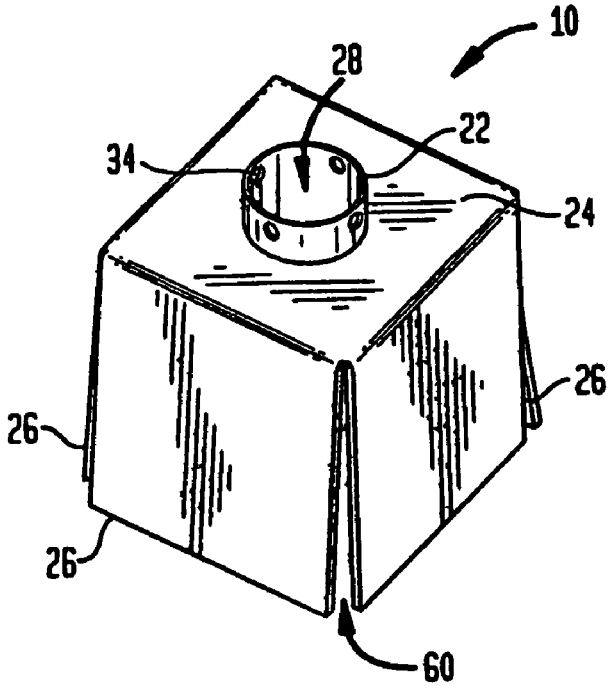
FIG. 6 is a perspective view of a fixture for a hollow post without access openings.

Extending from the fitting 22 is a web 24 that serves to connect the fitting 22 to a plurality of friction plates 26. In the preferred embodiment (FIG. 2), fitting 22 extends below web 24. However, fitting 22 can also extend above and/or below web 24 as depicted in FIGS. 3, 5 and 6.

As depicted in FIGS. 2-6, in the preferred embodiment, web 24 is in the form of a horizontal, square plate. The shape of the web 24 is not essential so long as it provides adequate support for the friction plates 26 against typical forces that might be applied to the hollow post once assembled. In some embodiments, support fins 50 such as those depicted in FIG.

Figure 4:
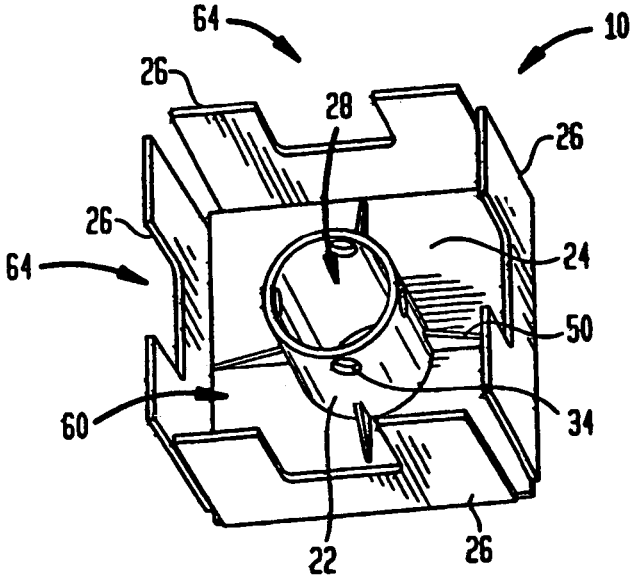
FIG. 4 is a bottom perspective view of a preferred fixture of the invention.

4 can be employed to provide additional strength to the web 24. In FIG. 4, the support fins 50 are shown radially extending from the fitting 22.

There are a number of manufacturers of hollow posts, and particularly vinyl fence posts, and the inner dimensions of such posts can vary from manufacturer to manufacturer, by design, and within acceptable manufacturing tolerances. To accommodate for these variations, the present invention uses resilient and/or resiliently connected friction plates 26 to position the post in relation to an elongated support 14.

In the preferred embodiment, friction plates 26 are essentially rectangular in form, and connected to a plate-shaped web 24 along the upper edge 38 thereof. In a preferred embodiment, the vinyl material of which the fixture 10 is constructed forms a resilient connection along edge 38 between the web 24 and friction plate 26, allowing the plate to move inward when pressure is applied against outer surface 40 of the friction plate 26. The thickness and type of material employed at the connection determines the resiliency of the connection, which also affects the amount of frictional resistance applied to the inner surface of the hollow post.

Referring again to FIGS. 2-6, friction plates 26 include a first, outer surface 40 for engaging a portion of an inner surface 46 (FIG. 1) of a rectangular hollow post along the width or length thereof. Generally, bore 28 and pipe 14 share a common longitudinal axis 44 and web 24 is disposed transverse thereto. Plate 24 has a length L1 and a width W1 which are less than the length and width (not shown) of the inner cross section of hollow post 12. Friction plates 26 extend from edge 38 at an obtuse angle A (FIG. 2) such that a length L2 (or width W2) (seen in FIGS. 2 and 5) formed between two opposing friction plates 26 is greater than that of the length and/or 30, width (not shown) of the inner cross section of hollow post 12. When a hollow post 12 is fitted over one or more fixtures 10 secured to an elongated structure 14, the friction plates 26 are forced inwards, frictionally engaging the inner surfaces 46 (FIG. 1) of the hollow post.

In a preferred embodiment, in addition to the resilient connection along edge 38, the friction plates 26 also are constructed of a material, and of a thickness, that imparts a certain amount of resiliency. Thus, in addition to flexing at edge 38, the friction plates may also bend against the inner surfaces 46 when disposed within a hollow post.

Although resiliency of the connection between the friction plates 26 and the web 24 is employed to position the hollow post in connection with the elongated support, the connection must also be of sufficient strength to resist external forces applied to the post in its assembled form without breaking. In the preferred embodiment, support connectors 62 (FIG. 2) are included which extend between adjacent friction plates 26 to impart additional strength.

In yet another preferred embodiment, instead of support connectors 62, the fixture 10 can employ a plurality of support fins 72, as shown in FIGS. 13-14. The support fins 72 are formed at the junction between the web 24 and friction plates 26. The support fins 72 include an upper portion 74 with a first edge 78 connected to the bottom of web 24. Extending from the upper portion 74 of the support fins 72 is a lower portion 76. A second edge 80 extends along the upper and lower portions 74,76 and connects to inner surface 82 of the friction plates 26. In a preferred embodiment, the elongated second edge 80 extends almost the entire length of the friction plates 26.

The support fins 72 typically have a plate-like structure. The thickness of the fins 72, and the dimensions of the fins overall, can be varied, thereby affecting the strength and rigidity of the friction plates, and the resulting amount of resistance provided when a hollow post is fitted onto the fixture 10. For example, length of the lower portion 76 can be varied, the longer structure providing greater strength and rigidity.

The positioning of the support fins 72 is best illustrated in connection with FIG. 14. In a preferred embodiment, each friction plate includes two such structures, one providing additional support to each of the lower plate portions 84 separated by access opening 64 (see FIG. 2). In a preferred embodiment, the support fins 72 extend in substantially transverse orientation to both the web 24 and the friction plates 26. In operation, these support fins 72 provide additional support to the friction plates 26 against forces applied to the external surfaces 40 thereof.

While the term "plate" is used, it will be recognized by those of skill in the art that the overall shape of the plates is not critical, so long as each friction plate 26 includes an outer surface 40 for engaging an inner surface 46 of a hollow post along a length or a width thereof. Further, the number of friction plates 26 may vary, however, there should be at least two opposing friction plates, as shown, for example, in the embodiment of FIG. 5. Preferably, four friction plates are provided as depicted in FIGS. 2-4 and 6.

Referring to FIG. 6, there is shown another embodiment of a fixture 10, wherein the friction plates 26 are in the form of a solid rectangular plate. As shown, these plates combine to form a hollow cavity 60 underlying web 24. As in the preferred embodiment, depicted in FIG. 2, the fitting 22 may extend below the web 24 into this hollow cavity 60. In several embodiments of the fixture 10 of the invention, fasteners 32 including holes 34 are provided in this portion of the fitting within the hollow cavity 60. To allow for access to these fasteners, preferably there is provided an access opening 64 in one or more of the friction plates 26 to allow for access to the fastener. In the preferred embodiment (FIG. 2) there are access openings 64 provided in each of the four friction plates 26.

The preferred embodiment of the mounting fixture of the invention is injection molded from vinyl or other suitable plastics.

When mounting a post to an earth foundation, an elongated support 14, such as a pipe, can be placed within an excavated hole, and can then be fixed in place by the use of concrete. The vertical alignment of the pipe can be readily adjusted by simply shifting the position of the pipe within the concrete before it sets. However, when using a post in connection with a bass structure other than an earth foundation, for example a wood deck, a mount is typically provided, and it is not as simple to adjust the vertical alignment of the post. Typically, shims are placed under a portion of the mount to adjust the vertical alignment, however, this has many disadvantages.

Figure 7:
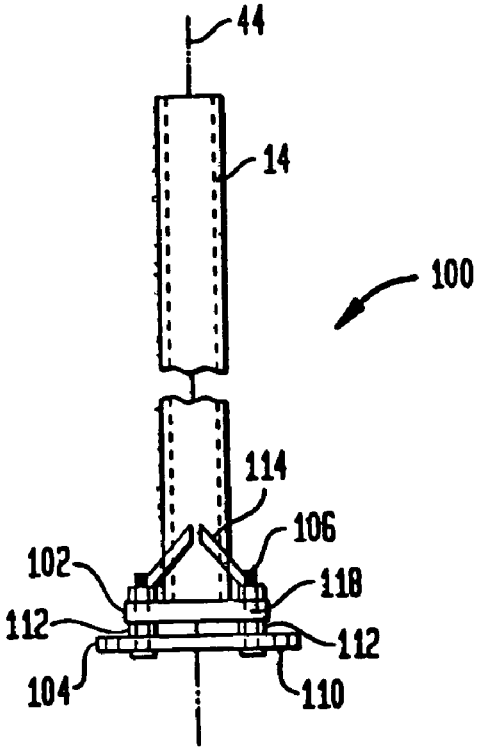
FIG. 7 is a side view of an adjustable mount for a hollow fence post.
Figure 8:
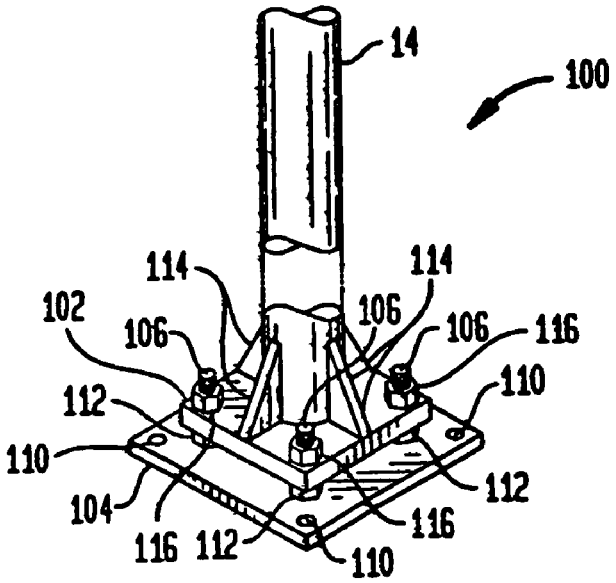
FIG. 8 is a side perspective view of an adjustable mount for a hollow fence post.
Figure 9:
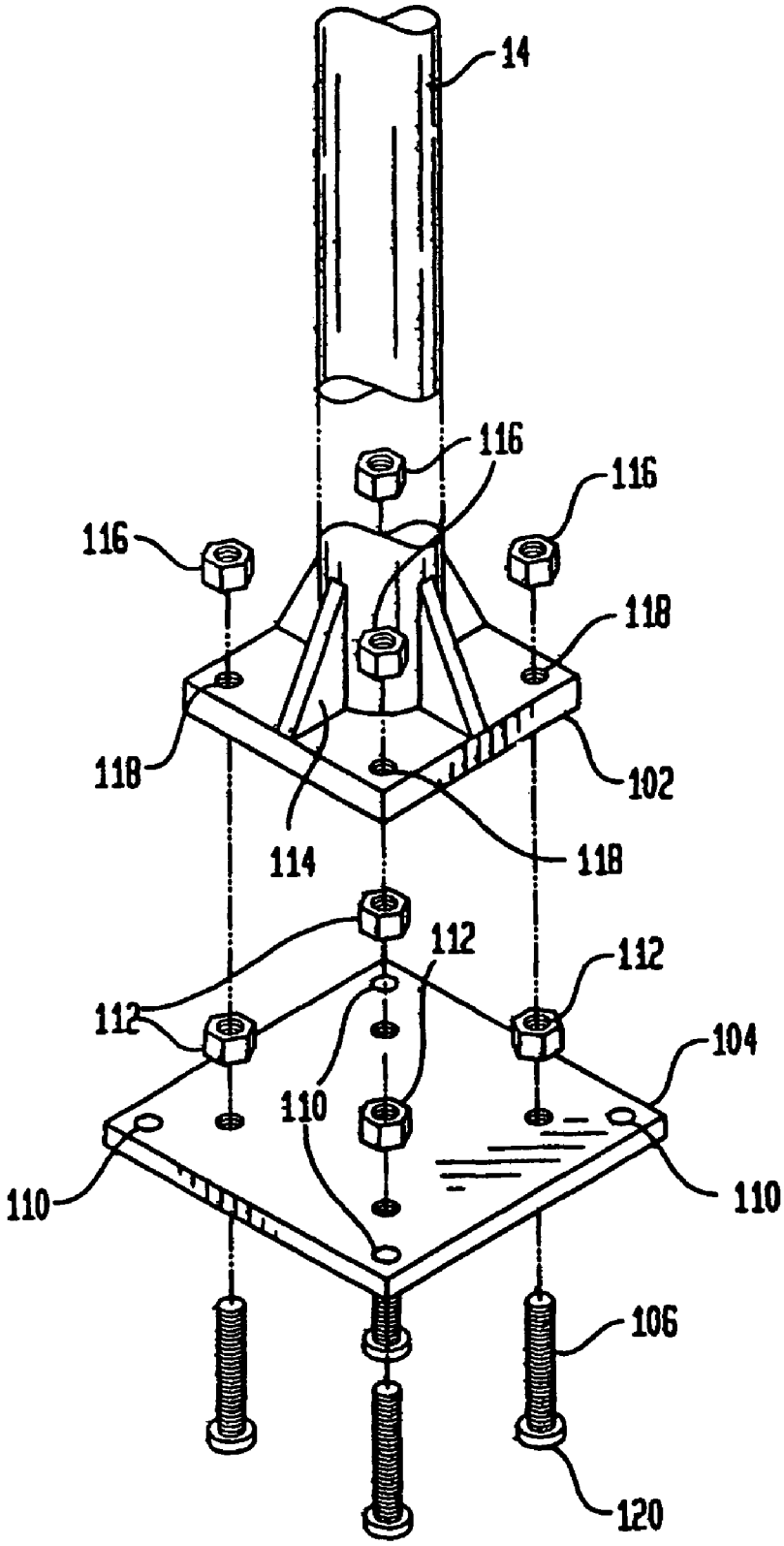
FIG. 9 shows an adjustable mount of the invention in disassembled format.

Referring to FIGS. 7-9, there is shown an adjustable mount assembly 100 which generally includes an elongated support structure 14, preferably a pipe, mounting bracket 102, and base 104. Base 104 includes a plurality of threaded members 106 which extend upwardly therefrom. Each threaded member 106 is rotatably engaged with an adjustment member, preferably a nut, 112. Preferably, the threaded members 106 are bolts having a flattened head 120 (FIG. 9) which sits flush with the base 104 when positioned on an underlying support. Alternatively, the threaded members may be welded to the base.

Mounting bracket 102 includes a plurality of holes 118 which are adapted to receive threaded members 106 when the mounting bracket 102 is positioned over base 104. Elongated support structure 14 may be attached to the base by any number of methods, preferably by welding. Optionally, angle supports 114, welded at an angle between the elongated support 14 and mounting bracket 102, can be provided for additional strength.

When installing the mounting assembly 100 of the present invention, base 104 is secured to a base structure 18, such as a cement floor or wood deck. In the preferred embodiment, bolts, screws, nails or other fastening means are employed to secure the base 104 through holes 110. Mounting bracket 102, with attached elongated support 14, is then positioned over the base and brought to rest upon the adjustment members 112. Rotating any, one of the adjustment members 112 will change the vertical orientation of the elongated support 14.

Once the elongated support 14 has been properly aligned, a locking nut 116 (FIG. 8) is engaged with threaded member 106, securing the mounting bracket 102 in place. To prevent the bolts from loosening over time, stops (not, shown) may be employed. The stops generally consist of a piece of tubular plastic which may be cut to a desired length and fitted around the exposed portion of the threaded member 106 between threaded member 106 and base 104.

Once the elongated support 14 has been mounted, either by the mounting assembly 100 of the present invention, or otherwise, one or more fixtures 10 may be fitted over the elongated support 14 and placed in the desired position. Using fasteners 32, the fixtures 10 are then secured to the elongated support 14. Hollow post 12 can then be placed over the elongated support 14 and fixtures 10.

Depending on the application of the post now installed, various hardware may be attached to the post via conventional means. Typically this is by the use of screws. In the case of a post for a fence assembly, this hardware may consist of brackets for horizontal fence members, or may includes hinges or other hardware for a gate. While vinyl posts have many advantages, one disadvantage is that the thickness of the walls is often insufficient for proper mounting of such hardware using conventional screws. However, if the fixtures of the present invention are positioned properly, screws can be driven through both the walls of the post and the friction plates 26 of the fixture 10, providing the desired additional support.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A post assembly comprising:

an elongated support structure adapted to extend from a ground surface;

a hollow post having an inner cross-section defined by a plurality of inner walls, said support structure disposed within said post; and at least one fixture disposed within said post, said fixture comprising a fitting having a bore, said support structure disposed within said bore such that a first portion of said support structure extends beyond said fitting in a first direction and a second part of said support structure extends beyond said fitting in a second direction, a web, in the form of a rectangular plate dimensioned smaller than the inner cross-section of the hollow post, extending outwardly from said fitting such that said bore extends through said plate, a plurality of resilient friction plates extending at outward obtuse angles from said web toward the ground surface, each friction plate having a first surface engaging a portion of one of said inner walls of said post, said friction plates positioned so that at least two opposing inner walls of said post are frictionally engaged by opposing friction plates, at least one of said friction plates including an access notch permitting access to said bore by a fastener, a first aperture in said bore, said aperture being directly adjacent said access notch, at least one support fin connected between said web and each said friction plate.

2. The post assembly of claim 1, wherein said fixture includes four friction plates, each friction plate engaging a separate inner wall of said post.

3. The post assembly of claim 1, wherein said friction plates adjust to accommodate hollow posts of different dimensions.

4. The post assembly of claim 1, wherein said web comprises a horizontal plate with respect to the ground surface, said horizontal plate including four peripheral edges and having a length and width less than that of said inner cross-section of said hollow post, said friction plates extending from respective edges of said horizontal plate.

5. The post assembly of claim 1, wherein said hollow post is adapted to fit over said fitting such that said friction plates are progressively deformed as said hollow post advances toward the ground surface during installation thereof.

6. The post assembly of claim 1, wherein said support structure includes a longitudinal axis, and said fitting comprises an elongated hollow cylinder defining said bore, said web extending outwardly from said fitting transverse to said longitudinal axis of said support structure.

7. The post assembly of claim 6, wherein said fitting further comprises at least one elongated expansion slot.

8. The post assembly of claim 7, wherein said fitting includes four elongated expansion slots.

9. The post assembly of claim 1, wherein said fitting is attached to said support structure by at least one fastener.

10. The post assembly of claim 1, wherein said bore is continuous from one side of said web to the other.

11. A post assembly comprising:

a hollow post having a square inner cross-section defined by four inner walls;

a pipe including a longitudinal axis disposed within said post, said pipe extending from a base surface; and at least one fixture disposed within said post, said fixture comprising a fitting having a bore, said pipe disposed within said bore, a web extending from said fitting transverse to said longitudinal axis of said pipe, and four friction plates extending at obtuse angles from said web toward the base surface to form a hollow cavity underlying said web at least one of said friction plates having an access notch in a center portion thereof, through which a first fastener can be engaged to secure said fixture to said support structure, each friction plate having a first surface that engages one of said inner walls of said post along a portion thereof, said friction plates positioned so that each of said inner walls of said post are frictionally engaged by a separate friction plate, said bore being disposed within said hollow cavity on one side of said web and above said hollow cavity on a second side of said web, said bore having apertures to permit a fastener to be threaded therein.

12. The post assembly of claim 11, wherein said web comprises a horizontal plate, said horizontal plate including four peripheral edges and having a length and width less than that of said inner cross-section of said hollow post.

13. The post assembly of claim 11, wherein said fixture further comprises a plurality of support fins connected between said web and said friction plates.

14. The post assembly of claim 13, wherein said fitting further comprises at least one elongated expansion slot.

15. The post assembly of claim 11, wherein said fixture further comprises at least one support fin connected between said web and each said friction plate.

16. The post assembly of claim 11, wherein said fitting further comprises at least one elongated expansion slot.

17. The post assembly of claim 11, wherein said fitting is attached to said pipe by at least one fastener.

18. A fixture for mounting a hollow post to a support structure comprising:

a fitting including a bore adapted to receive the support structure;

a web extending from said fitting such that portions of said fitting are above and below said web; and a plurality of friction plates extending at obtuse angles from and connected to said web to form a hollow cavity below said web, the hollow cavity including support fins and the friction plates including access notches to permit use of a fastener to affix said fixture to the support structure, the access notches being positioned approximately at the center of the friction plates such that perpendicular approach of the fastener relative to the friction plates will cause said fastener to extend into the support structure, the friction plates being resiliently biased from said web.

19. The fixture of claim 18, further comprising a fastener aperture for securing said fixture to said support structure, said fastener aperture positioned above said web.

20. The fixture of claim 19, wherein said fitting further comprises a second fastener aperture adapted to receive a threaded fastener for securing said fitting to said elongated support structure, said second fastener aperture being positioned below said web.

21. The fixture of claim 19, wherein at least one of said friction plates has an access notch through which a fastener can be engaged to secure said fixture to said support structure.

22. The fixture of claim 18, wherein said fixture includes four rectangular friction plates.

23. The fixture of claim 18, wherein said bore is cylindrical, and wherein said elongated support structure has a cylindrical shape.

24. The fixture of claim 18, wherein said web includes a horizontal plate, said horizontal plate including four peripheral edges, said friction plates extending from said respective edges of said horizontal plate.

25. A fixture for mounting a hollow post comprising:

a fitting having a cylindrical bore adapted to receive a support pipe, said bore having a longitudinal axis;

a rectangular plate having four peripheral edges and extending outwardly from said fitting perpendicular to said longitudinal axis, said fitting positioned centrally with respect to said plate; and a plurality of friction plates, at least two of said friction plates being resiliently biased and extending outwardly at obtuse angles from opposing edges of said rectangular plate, the friction plates including access notches to permit entry of a fastener to said bore, said access notches being positioned approximately at the center of the friction plates such that perpendicular approach of the fastener relative to the friction plates will cause said fastener to extend into the support pipe, the friction plates being resiliently biased from said web.

26. The fixture of claim 25, wherein said fixture includes four friction plates, each friction plate extending from a separate peripheral edge of said rectangular plate.

27. The fixture of claim 25, wherein said fitting extends through said rectangular plate.

28. The fixture of claim 25, wherein said friction plates define a hollow cavity underlying said rectangular plate, said fitting extending into said hollow cavity.

29. The fixture of claim 25, further comprising a plurality of support fins connected between said rectangular plate and said friction plates.

30. The fixture of claim 29, wherein said fitting comprises at least one elongated expansion slot.

31. The fixture of claim 25, further comprising at least one support fin connected between said rectangular plate and each said friction plate.

32. The fixture of claim 25, wherein said fitting comprises at least one elongated expansion slot.

* * * * *